US007935194B2

(12) United States Patent
Rolek

(10) Patent No.: US 7,935,194 B2
(45) Date of Patent: May 3, 2011

(54) DISHWASHER WITH TARGETED SENSING

(75) Inventor: Robert Jacob Rolek, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 396 days.

(21) Appl. No.: 11/845,158

(22) Filed: Aug. 27, 2007

(65) Prior Publication Data

US 2009/0056754 A1 Mar. 5, 2009

(51) Int. Cl.
*B08B 3/00* (2006.01)

(52) U.S. Cl. ..... 134/56 D; 134/58 D

(58) Field of Classification Search ..... None
See application file for complete search history.

(56) References Cited

U.S. PATENT DOCUMENTS

| | | | | |
|---|---|---|---|---|
| 4,993,444 | A * | 2/1991 | Toriyama et al. | 134/181 |
| 6,432,216 | B1 | 8/2002 | Thies | |
| 6,666,218 | B2 * | 12/2003 | Lavoie et al. | 134/25.2 |
| 6,675,818 | B1 | 1/2004 | Schrott et al. | |
| 7,086,406 | B2 | 8/2006 | Jung et al. | |
| 2006/0130876 | A1 | 6/2006 | Curtius et al. | |

FOREIGN PATENT DOCUMENTS

| | | | |
|---|---|---|---|
| DE | 19806559 | A1 | 8/1999 |
| EP | 0717953 | A1 | 6/1996 |
| EP | 0943287 | A1 | 9/1999 |
| EP | 1192892 | A1 | 4/2002 |
| EP | 1530942 | A1 | 5/2005 |
| WO | 03/051173 | A1 | 6/2003 |
| WO | 2006/015934 | A1 | 2/2006 |

* cited by examiner

*Primary Examiner* — Michael Barr
*Assistant Examiner* — Jason Y Ko
(74) *Attorney, Agent, or Firm* — Robert A. Bacon; McGarry Bair PC

(57) ABSTRACT

An automatic dishwasher comprises a housing defining a wash chamber for holding utensils to be washed, a movable sensor for determining a utensil load within at least one preselected location within the wash chamber, and a controller operably coupled to the movable sensor to control the direction of movement of the movable sensor to determine the presence and size of a utensil load in the at least one preselected location within the wash chamber.

20 Claims, 8 Drawing Sheets

DISHWASHER WITH TARGETED SENSING

BACKGROUND OF THE INVENTION

1. Field of the Invention

The invention relates to utensil load and soil load sensing devices for automatic dishwashers.

2. Description of the Related Art

Conventional household automatic dishwashers frequently have rotating spray arms for spraying cleaning and rinsing liquids on utensils. Such dishwashers also typically provide a limited selection of wash cycles. For example, a prior art dishwasher can provide a default wash cycle appropriate for most utensil loads and soil levels. Other cycles may include a "pots and pans" cycle for cleaning cooking utensils which may be heavily soiled. A "fragile" cycle can be used for china, crystal, glassware, and the like.

Prior art dishwashers also typically comprise a fixed spray arm assembly in the center of the dishwasher floor that sprays wash liquid uniformly throughout the wash chamber. This can result in wash liquid being sprayed in areas that have no utensils if the dishwasher contains less than a full load of utensils. Cleaning and resource usage is less than optimal due to the spraying of wash liquid in empty areas that could better be concentrated in areas occupied by utensils.

The availability of only a limited number of cycles can result in using wash cycles that may be inappropriate for some loads or for mixed loads. For example, a "pots and pans" cycle may be suitable for heavily-soiled cooking utensils, but may be overly hot and long for tableware, thereby contributing to excessive water, detergent, and energy consumption. Furthermore, selection of a wash cycle based upon the majority of the utensils in the dishwasher may result in incomplete cleaning of more heavily soiled utensils.

There is a need for a dishwashing system that can sense the load size and level of soiling of utensils within the dishwasher, and can adjust spray patterns, spray duration, and spray pressure based upon load size and soil levels at selected locations within the dishwasher.

SUMMARY OF THE INVENTION

An automatic dishwasher comprises a housing defining a wash chamber for holding utensils to be washed, a movable sensor for determining a utensil load within at least one preselected location within the wash chamber, and a controller operably coupled to the movable sensor to control the direction of movement of the movable sensor to determine the presence and size of a utensil load in the at least one preselected location within the wash chamber.

A method of determining at least one of the presence of a load of utensils and the soil load of the utensils in an automatic dishwasher having a wash chamber in which the utensils are received comprises moving a sensor into at least one sub-portion of the wash chamber, and determining the presence of utensils in the at least one sub-portion of the wash chamber.

DESCRIPTION OF AN EMBODIMENT OF THE INVENTION

The invention provides a dishwasher sprayer assembly that can selectively direct liquid to a preselected location within the wash chamber, a sensor assembly for determining a load value at selected locations within the dishwasher, and determining the preselected location based upon the load value determined by the sensor assembly, thereby providing a targeted sensing and washing assembly. The load value can be reflective of either or both a utensil load, i.e. the number and/or size of the utensils in the dishwasher, and/or a soil load, i.e. the quantity of soil on the utensils.

Figure 1:
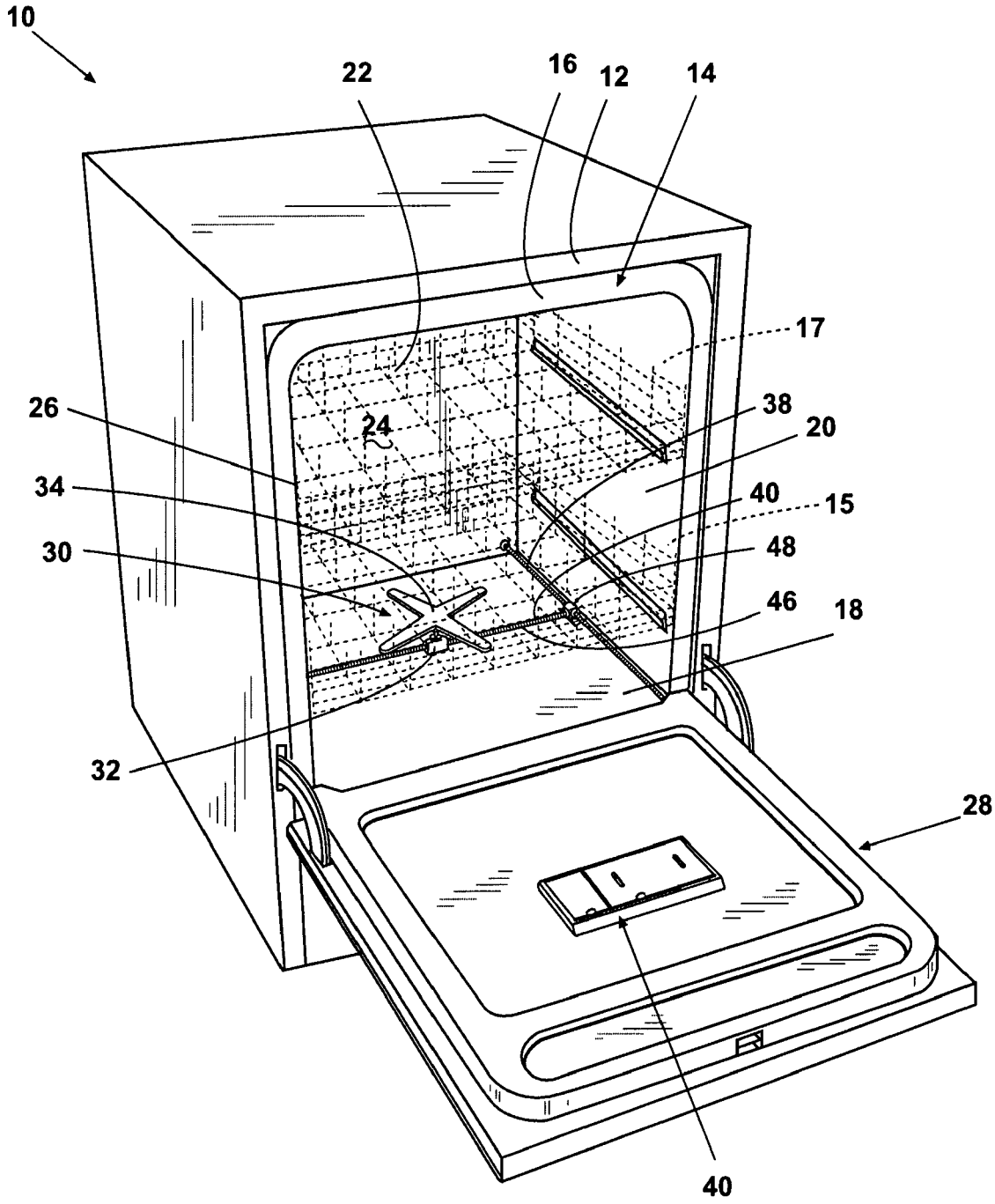
FIG. 1 is a perspective view of a first embodiment of a dishwasher comprising a targeted sensing and washing assembly according to the invention, with portions removed for clarity.

Referring now to the figures and to FIG. 1 in particular, an embodiment of the invention is illustrated comprising an automated dishwasher 10 having a housing 12 for enclosing a wash tub 14. The dishwasher 10 shares many features of a conventional automated dishwasher, which will not be described in detail herein except as necessary for a complete understanding of the invention. The wash tub 14 has spaced top and bottom walls 16 and 18, spaced side walls 20 generally orthogonal to the top and bottom walls 16 and 18, and a rear wall 22 substantially orthogonal to the top and bottom walls 16 and 18 and the side walls 20. The walls 16, 18, 20, and 22 join along their respective edges to define a wash chamber 24 with an open face 26. Utensils, such as plates, bowls, silverware, glassware, pots, pans, and the like, are received in at least one movable basket 15, 17 in the wash chamber 24 during a dishwashing cycle.

A door 28 is hingedly mounted to the dishwasher 10 and can move between an opened position, as illustrated in FIG. 1, to provide access to the wash chamber 24 and a closed position (not shown) to close the wash chamber 24 by covering the open face 26 of the wash chamber 24. Typically, the door 28 is in the opened position when utensils are loaded or unloaded into the dishwasher and in the closed position while the dishwashing cycle is running or while the dishwasher 10 is not in use. A bulk wash aid dispenser 44 is mounted on an inside surface of the door 28 such that the bulk wash aid dispenser 44 is disposed in the wash chamber 24 when the door 28 is in the closed position.

Additionally, the dishwasher 10 comprises a liquid circulation system for introducing and circulating liquid and wash aids, such as detergents, rinse aids, and the like, throughout the wash chamber 24. A sprayer assembly 30 comprises a portion of the liquid circulation system for spraying liquid against utensils placed in the wash chamber 24. The sprayer assembly 30 comprises a rotatable sprayer 34 supported on a movable sprayer carriage 32. The movable sprayer carriage 32 is configured for selective bi-directional movement to position the sprayer 34 at a selected location in the wash chamber 24, as hereinafter described. The bi-directional movement can be effected by assemblies containing one or more of gears, shafts, springs, wheels, motors, and other suitable mechanical or electromechanical devices known to a person of ordinary skill in the art. The invention will be described herein with respect to assemblages of motors, shafts, and gears. However, the particular embodiments of the invention described herein should not be construed as limiting the scope of the invention.

The sprayer assembly 30 is illustrated schematically in FIG. 2 as comprising the movable sprayer carriage 32 configured to move horizontally along a movable lead screw 40 extending generally between the side walls 20, and a fixed lead screw 38 extending generally transversely, preferably orthogonally, to the movable lead screw 40, as hereinafter described. Each shaft 38, 40 rotates about its longitudinal axis, as hereinafter described. The sprayer assembly 30 also comprises a rail 50 for partially supporting the movable lead screw 40, a rod carriage 48 for coupling the movable lead screw 40 to the fixed lead screw 38, motors for rotating the lead screws 38, 40, and associated power, control, and liquid supply lines, all as hereinafter described.

Figure 2:
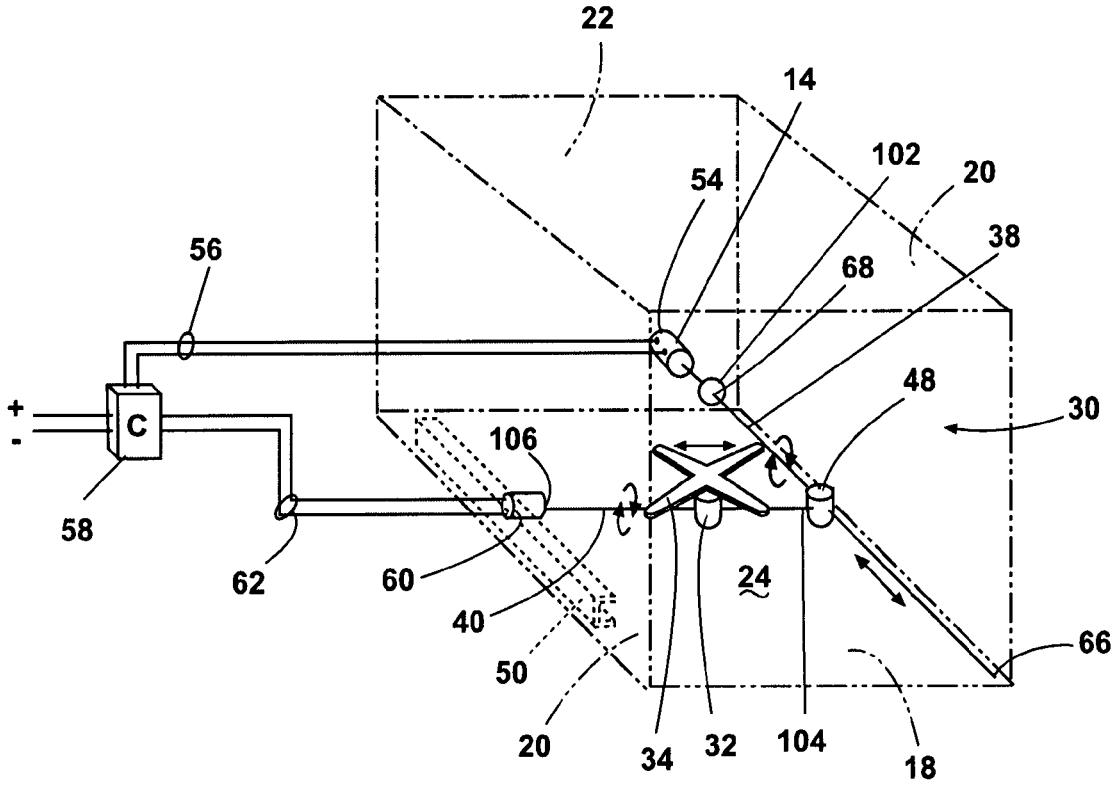
FIG. 2 is a schematic view of the targeted sensing and washing assembly of FIG. 1.

FIG. 2 illustrates the sprayer assembly 30 comprising a first embodiment of a drive and control system. The fixed lead screw 38 is an elongated rod-like member having helical threads extending along the full length thereof, and having a first end 66 and a second end 68. The fixed lead screw 38 is supported at the first end 66 for rotation about its longitudinal axis by a suitable bearing assembly (not shown) located at the front of the wash chamber 24. The second end 68 of the fixed lead screw 38 can extend through a fixed lead screw aperture 102 in the rear wall 22 for direct coupling with a suitable electric motor 54 located outside the wash chamber 24 for controlled rotation of the fixed lead screw 38 about its longitudinal axis. Preferably, the fixed lead screw aperture 102 is suitably configured for water tightness by the employment of well-known devices, such as seals, boots, grommets, and the like, enabling the operable coupling of the motor 54 to the fixed lead screw 38.

The movable lead screw 40 is an elongated rod-like member having helical threads extending along the full length thereof, and having a first end 104 and a second end 106. The movable lead screw 40 can be coupled with an electric drive motor 60 located within the wash chamber 24 and which is suitably sealed against wash liquid. The first end 104 of the movable lead screw 40 is coupled to the fixed lead screw 38 through a movable rod carriage 48, as hereinafter described. The second end 106 is coupled to the motor 60 for rotation of the movable lead screw 40 about its longitudinal axis. The drive motor 60 can be coupled to the lead screw 40 through a motor axle, or integrated with the lead screw 40. The movable drive motor 60 receives electrical power through suitable power leads 62 extending through the side wall 20 and coupling the movable drive motor 60 with a controller 58. The motor 54 receives electrical power through suitable power leads 56 coupling the motor 54 with the controller 58. Both motors 54, 60 are preferably capable of forward and reverse rotation. The controller 58 is also coupled electrically with a power supply, and with a control panel (not shown) comprising a user interface (not shown) for selecting such operations such as a selected wash cycle, the type of dry cycle, the temperature of the wash and/or rinse liquid, and the like.

Figure 3:
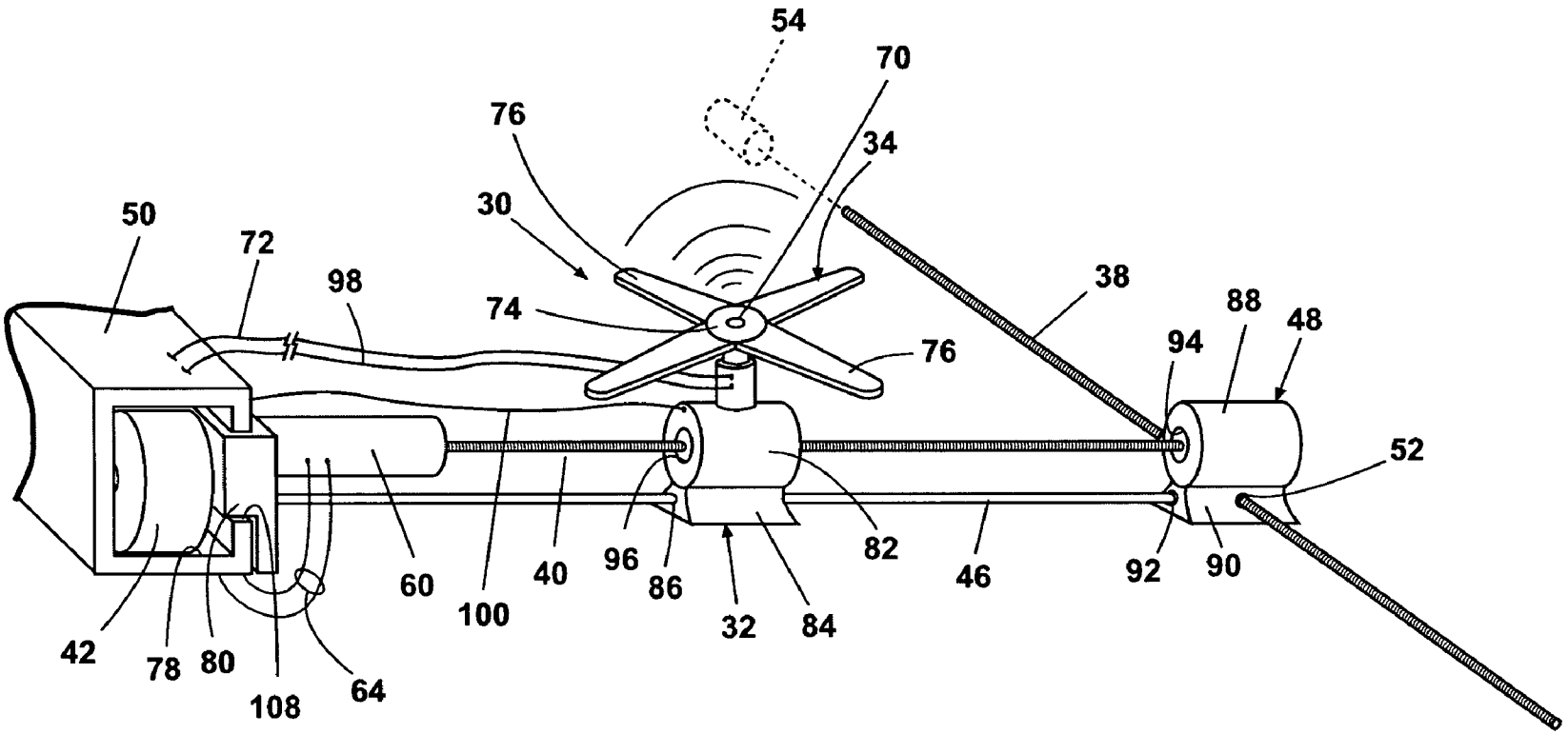
FIG. 3 is an enlarged perspective view of a movable sprayer comprising a portion of the targeted sensing and washing assembly of FIG. 1.

FIG. 3 illustrates the configuration and mechanical operation of the sprayer assembly 30. As previously described, the sprayer assembly 30 comprises the fixed lead screw 38 and the movable lead screw 40, which are both configured for selective positioning of the sprayer 34 within the wash chamber 24. The rod carriage 48 is a somewhat compound body comprising a closed-end, annular collar 88 defining a cylindrical receptacle 94, and a flange 90 depending radially therefrom. The receptacle 94 is configured with a smooth wall for rotational seating of the first end 104 of the movable lead screw 40 therein. The receptacle 94 can be lined with a low-friction material, such as nylon or polytetrafluoroethylene (PTFE, also known as Teflon®), to facilitate the rotation of the lead screw 40 therein. Alternatively, the lead screw 40 can terminate in a low-friction bearing, such as a ball bearing, seated in the receptacle 94 to facilitate rotation of the lead screw 40. The receptacle 94 is configured with a diameter slightly greater than the diameter of the lead screw 40 to minimize lateral movement and vibration of the lead screw 40 within the receptacle 94 while enabling rotation of the movable lead screw 40 therein.

The flange 90 is a suitably-shaped body having two orthogonally disposed openings 52, 92. The lead screw aperture 52 is oriented orthogonal to the axis of the collar 88 and extends through the flange 90. The lead screw aperture 52 is threaded for threadable registry with the fixed lead screw 38 therethrough. The lead screw aperture 52 can be lined with a low-friction material, such as nylon or PTFE, to facilitate the threadable rotation of the lead screw 38 therein. The threads of the lead screw aperture 52 and lead screw 38 are configured so that rotation of the lead screw 38 can result in the longitudinal translation of the rod carriage 48 along the lead screw 38.

The guide rod seat 92 is a smooth-walled, cylindrical cavity configured for fixed registry with a guide rod 46, as hereinafter described, and is generally orthogonal to the lead screw aperture 52.

An elongated track 50 comprises a C-shaped channel, which can be rigidly attached to the side wall 20 in spaced disposition to the fixed lead screw 38, to extend along the side wall 20 for support of the second end 106 of the lead screw 40. The track 50 can define a rectilinear channel way 78 there along for receipt of a wheel 42 configured for rotatable coupling with the drive motor 60 to facilitate rolling of the wheel 42 along the channel way 78 and translation of the movable lead screw 40 in a front-to-back direction. The "C" shape of the track 50 defines an open slot 108 extending the length of the track 50.

A rod and motor support block 80 is a rectilinear, block-like body configured for fixed attachment of the motor 60 and the guide rod 46 thereto. The motor 60 can be rigidly attached to the support block 80 through a suitable bracket (not shown). The rod and motor support block 80 can also be configured for rotatable attachment of the wheel 42 thereto. Preferably, the rod and motor support block 80 is configured to slidably fit within the open slot 108 of the track 50 to enable the rod and motor support block 80 to slidably translate along the track 50 while preventing rotation of the motor 60 relative to the rod carriage 48 and the rail 50. The open slot 108 and/or the rod and motor support block 80 can be provided with a low-friction surface, such as nylon or PTFE, on contacting faces to facilitate translation of the support block 80 along the track 50.

A guide rod 46 is an elongated, thin rod configured to be fixedly seated in the guide rod seat 92 and to extend generally from the flange 90 to the rod and motor support block 80 to couple the rod carriage 48 to the wheel 42, and having sufficient strength and durability for the purposes described herein. The guide rod 46 can be seated in a guide rod seat (not shown) in the rod and motor support block 80 similar to the guide rod seat 92. A first end of the guide rod 46 is seated in the rod aperture 92 and a second end of the guide rod 46 is seated in the rod and motor support block 80 to rigidly interconnect the rod 46, the motor support block 80, and the rod carriage 48.

A sprayer carriage 32 is a somewhat compound body comprising a closed-end, annular collar 82 defining a cylindrical lead screw aperture 96, and a flange 84 depending radially therefrom. The lead screw aperture 96 is threaded for threadable registry with the lead screw 40 therethrough. The lead screw aperture 96 can be lined with a low-friction material, such as nylon or PTFE, to facilitate the threadable rotation of the lead screw 40 therein. The threads of the lead screw aperture 96 and lead screw 40 are configured so that rotation of the lead screw 40 can result in the longitudinal translation of the sprayer carriage 32 along the lead screw 40.

The flange 84 is a suitably-shaped body having a rod aperture 86 extending therethrough for slidable receipt of the flange 84 along the guide rod 46. The rod aperture 86 can be lined with a low-friction material, such as nylon or PTFE, to facilitate the sliding of the flange 84 along the guide rod 46. The guide rod 46 enables the sprayer carriage 32 to translate along the lead screw 40 without rotating.

The sprayer carriage 32 supports the sprayer 34, which is fluidly coupled through a liquid delivery line 100 to a source of liquid for washing and rinsing utensils within the wash chamber 24. The sprayer 34 comprises a generally propeller-shaped body having a plurality of sprayer arms 76 extending from a central hub 74 for rotation about a vertical axis within a generally horizontal plane in a manner generally known in the art.

The dishwasher 10 can comprise a sensor for determining a load value at selected locations within the dishwasher. The load value can be reflective of either or both a utensil load, i.e. the number and/or size of the utensils in the dishwasher, and/or a soil load, i.e. the quantity of soil on the utensils. The hub 74 can be provided with a utensil load sensor 70 for sensing the size of the utensil load. A suitable utensil load sensor can comprise a conventional optical sensor capable of distinguishing between large and small numbers of utensils within a preselected portion of the wash chamber 24. One implementation of the optical sensor can be for the sensor to effectively generate an image of the pre-selected area in the wash chamber 24 and compare that to a reference image of the area when empty. As the surrounding tub is generally of one color or reflectance, the presence of utensils in the area can provide a difference reflectance, which can indicate the presence of utensils.

The sprayer 34 can be coupled to a pump assembly, valves, and related devices as are known in the art for delivering a controlled spray of liquid through the sprayer 34 into the wash chamber 24. The sprayer 34 can be provided with a valve assembly (not shown) which is operably coupled through a sprayer control lead 98 with the controller 58 for controlling the flow and pressure of the wash liquid delivered by the sprayer 34. The motor 60 is also coupled with the controller 58 through a power lead 64. To the extent that the lines 64, 98, 100 from the sprayer 34 and the motor 60 extend through a side wall 20 or the rear wall 22, the penetration through the side wall 20 or rear wall 22 can be configured with seals, boots, grommets, and the like for suitable water tightness.

The utensil load sensor 70 can be connected to the controller 58 through a suitable power and control lead 72 extending from the sprayer assembly 30 through a suitable watertight opening in the side wall 20 or rear wall 22. Output signals from the utensil load sensor 70 can be processed and stored by the controller 58 for use in determining the operational parameters of the dishwasher 10 during a dishwashing cycle.

A conventional turbidity sensor (not shown) can be utilized to determine the soil load associated with a selected grouping of utensils, such as the utensils associated with a particular area or quadrant of the wash chamber 24. Output signals from the turbidity sensor can also be processed and stored by the controller 58 for use in establishing, along with the data from the utensil load sensor 70, the operational parameters of the dishwasher 10 during a dishwashing cycle.

The sprayer assembly 30 provides a means of accurately controlling the operation of the sprayer 34 to optimize the utilization of water, cleaning aids, and energy, and the resulting cleaning of the utensils. This is accomplished by positioning the sprayer 34 at preselected locations for selected time periods based upon the results from the utensil load sensor 70 and turbidity sensor. The sprayer assembly 30 can also be configured to control the temperature, wash aid concentration, and pressure of the wash liquid based upon the sensor results.

Rotation of the movable lead screw 40 can urge the sprayer 34 into side-to-side movement between the sidewalls 20. Rotation of the fixed lead screw 38 can result in front-to-back movement of the rod carriage 48. Thus, selected rotation of the shafts 38, 40 can result in movement of the sprayer 34 to a preselected location within the wash chamber 24 by selective operation of the motors 54, 60, as controlled by the controller 58. To facilitate the control of the sprayer assembly positioning, the wash chamber 24 can be divided into preselected areas.

Figure 4:
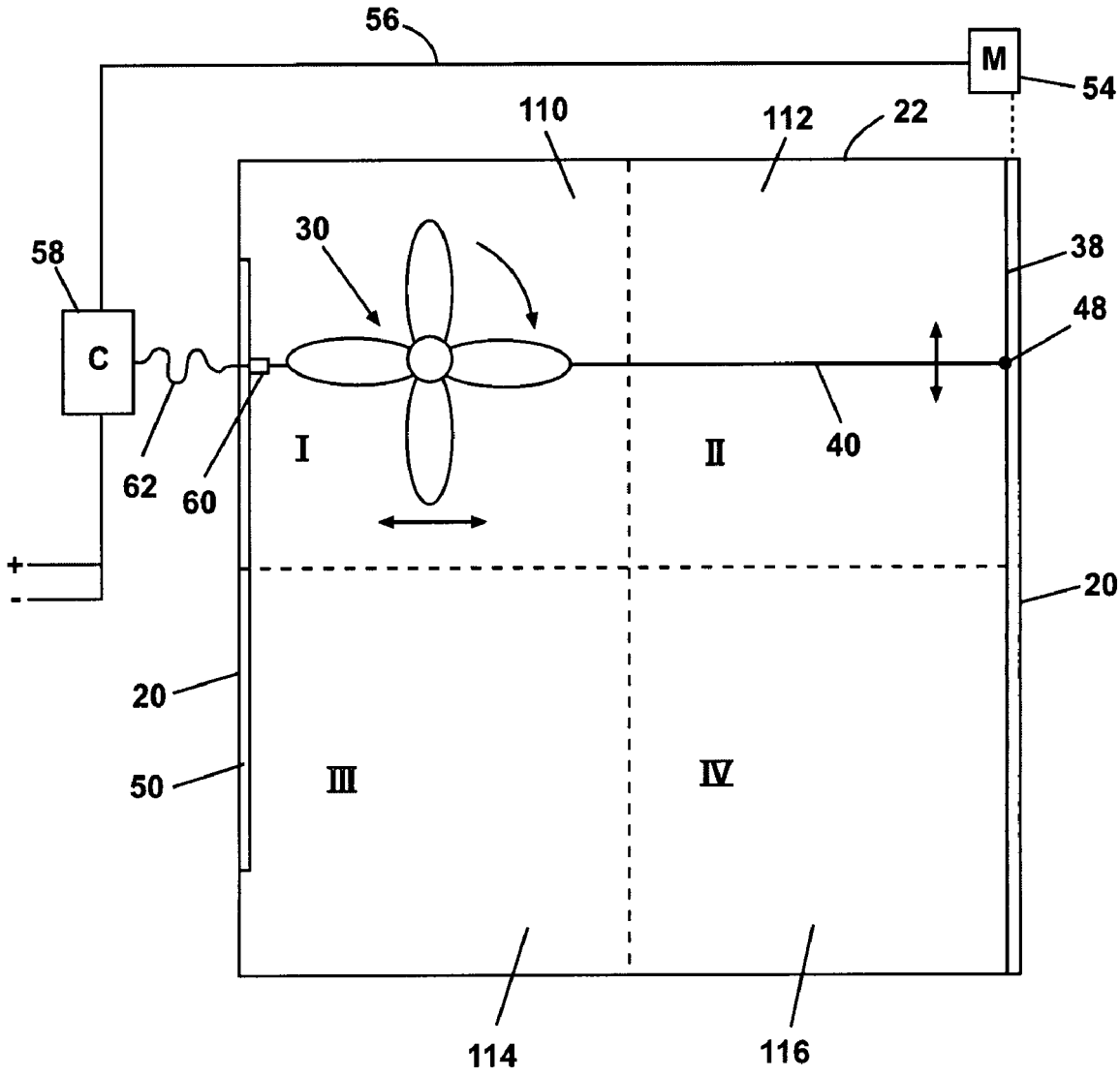
FIG. 4 is a schematic view of the targeted sensing and washing assembly of FIG. 1 showing the dishwasher divided into four quadrants.

FIG. 4 illustrates but one possible way of dividing the wash chamber into zones where the wash chamber 24 is divided into four quadrants 110-116, although a greater or lesser number of areas can be utilized. The areas also do not need to be of equal size. Given the size of most utensils placed in the dishwasher, dividing the wash chamber into 4 quadrants provides the functional resolution currently needed.

The controller 58, by controlling the operation of the motors 54, 60, can locate the sprayer 34 in any one of the four quadrants. Moreover, the sprayer 34 can be positioned within the four quadrants 110-116 in a preselected sequence for preselected periods of time, or positioned progressively in each quadrant for equal periods of time depending upon the size of the utensil load and the soil load associated with each quadrant. Thus, for example, if the dishwasher 10 has been loaded such that the third quadrant 114 has no utensils, the controller 58 can operate the motors 54, 60 so that the sprayer 34 does not operate within the third quadrant 114. The utensil load and the sprayer operational details for each quadrant can be determined by the results from the sensor 70, or by user inputs.

For example, a user can selectively load utensils into selected quadrants, such as might be done if a less than full dishwasher load is to be cleaned. Additionally, the user can select one or more quadrants for loading of particularly heavily soiled utensils. At the beginning of the wash cycle, the user can then select the quadrants in which the sprayer 34 is to operate, and the relative soil load in each of the selected quadrants. This can be facilitated by the use of a graphical interface on the control panel, and with preprogrammed operational functions, such as water temperature, detergent concentration, water pressure, and the like, that can be selected by the user. In another embodiment, the dishwasher 10 can be configured so that the same types of utensils, for example, plates, pots, glassware, silverware, large serving utensils, and the like, are always loaded in a preselected location in the dishwasher. The controller 58 can have different preprogrammed functions for the different utensil locations based upon the likely soil load of the utensils in those locations. The sprayer 34 can then be controlled so that heavily soiled pots and pans in a predefined pots and pans location are cleaned with a different washing operation than less heavily soiled glassware in a predefined glassware location.

Another embodiment involves measuring the utensil load and soil load at the initiation of the wash cycle. This can be accomplished using the outputs from the utensil sensor 70 and the turbidity sensor.

The utensil load sensor 70 has been described herein as comprising an optical sensor. However, the utensil load sensor 70 can also comprise other sensors which can determine the presence and quantity of utensils in the wash chamber 24, such as an electromagnetic sensor, a sensor capable of determining the size of the utensil load by sensing the density of the items, or to an acoustic sensor, such as a device using sonar technology. Alternatively, the size of the utensil load can be determined indirectly through a water temperature determination. Such a method is described in U.S. Pat. No. 6,622,754, which is incorporated as though set forth fully herein. A preselected volume of water can be added to the wash chamber 24 at a determined temperature. The sprayer 34 can be operated to spray the water in a quadrant or other predefined area for a preselected period of time, and the drop in water temperature can be measured. The sprayer 34 can then be moved to another area or quadrant and the spraying repeated, with a second temperature drop determined. This can be repeated until the entire area of the wash chamber has been covered, area by area. Based upon the temperature drops, the size of the load in each area can be determined through a machine-specific algorithm correlating utensil loads with temperature drops.

The soil level of the utensils can also be determined by use of a sensor. Such a method is described in U.S. Pat. No. 7,086,406, which is incorporated as though set forth fully herein. Turbidity sensors are known in the art for determining the soil level of the liquid in the dishwasher, and consequently the soil load associated with the utensils. However, such sensors are typically configured to measure the turbidity of the liquid for an entire utensil load at selected stages during the wash cycle. A turbidity sensor according to the invention can be utilized to determine the soil load of selected portions of the utensil load at the beginning of the wash cycle in order to control the cleaning process according to the soil loading of the selected portions.

At the beginning of the wash cycle, a preselected volume of water can be added to the wash chamber 24, and the sprayer 34 can be moved and operated sequentially in preselected areas. After operating the sprayer 34 in each area and determining the turbidity of the liquid in that area, the sprayer assembly can then be moved to a new area and the turbidity measurement repeated. The changes in turbidity in each area are reflective of the soil load of the utensils associated with each area. Based upon the turbidity determinations, the sprayer 34 can be operated in the areas containing the more highly soiled utensils for a longer period of time to ensure complete cleaning of the utensils in that area. Areas having utensils with lesser soil loads would be subject to spraying for a shorter period of time. Additionally, the more heavily soiled utensils could be sprayed with wash liquid having a higher concentration of detergent or other wash aids, or higher pressure or temperature, to ensure satisfactory cleaning.

Different types of turbidity sensors have been developed for use in automated dishwashers. Regardless of the type of sensor utilized, determining the turbidity value of each area can utilize the same general procedure of moving the sprayer to each area sequentially and determining a change in turbidity from area to area in order to assign a turbidity value, and hence the soil loading, for the utensils associated with each area. The turbidity sensor can be an optical or light-based sensor, a system that correlates turbidity with the pressure change detected across a filter due to the accumulation of soil particles on the filter as described in U.S. Pat. No. 6,432,216, which is incorporated as though set forth fully herein, or a sensor operating on the wash liquid in the near infrared light frequency range, which is particularly useful for evaluating protein-based soil loads.

The above described turbidity measurement routine can be conducted to provide measurements of turbidity versus time for determining the degree to which the soil is dried or encrusted on the utensils in a particular area to aid in determining the operation of the sprayer in different areas.

Figure 5:
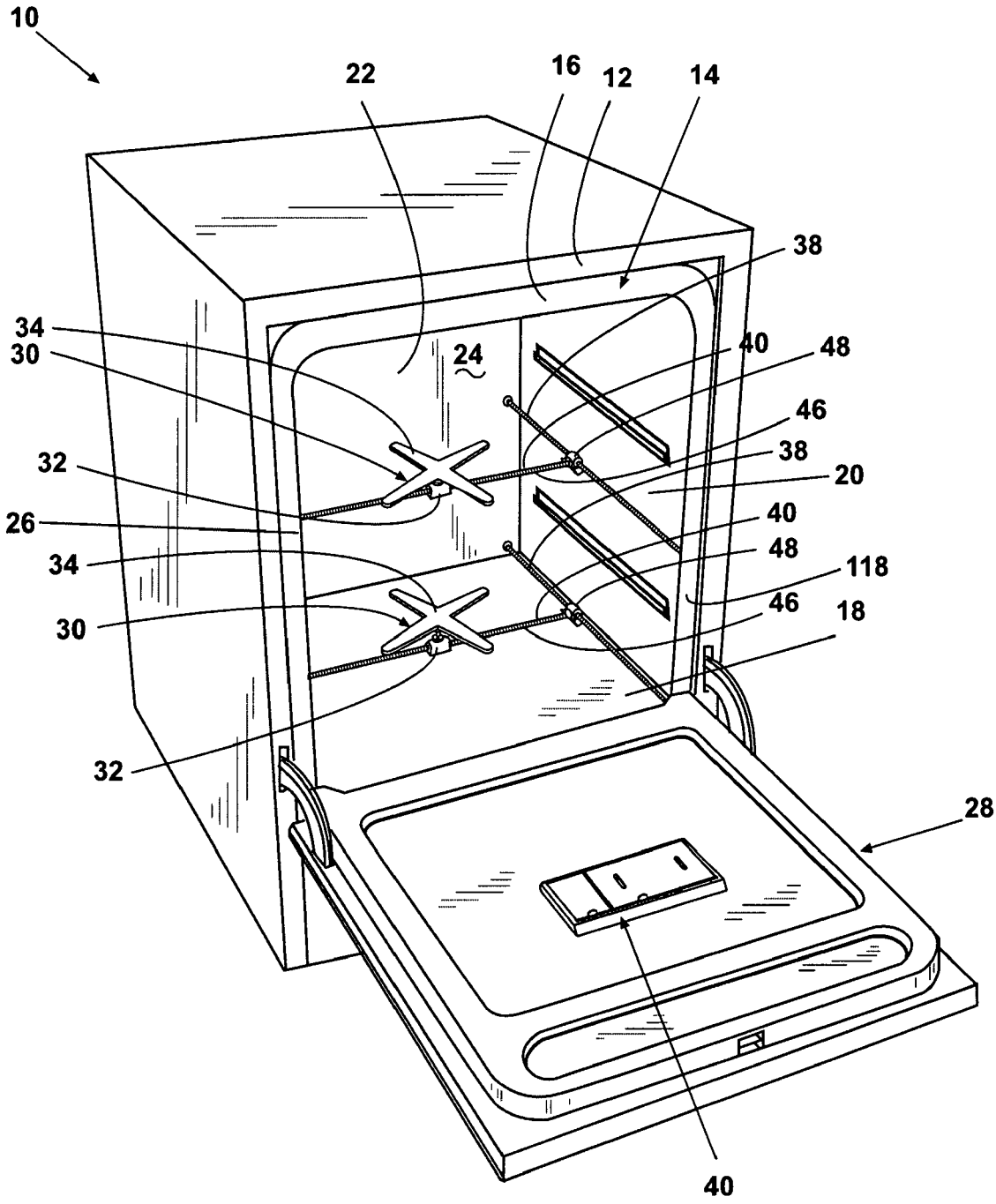
FIG. 5 is a perspective view of an alternate embodiment of the dishwasher illustrated in FIG. 1 showing a pair of targeted sensing and washing assemblies, with portions removed for clarity.

The invention has been illustrated and described in the context of a single sprayer assembly 30 located at the bottom of the wash chamber 24. A second sprayer assembly can be mounted within the wash chamber 24 intermediate and upper and lower utensil baskets in order to provide a similarly focused wash operation for utensils in the upper basket. Such a configuration is illustrated in FIG. 5. The upper assembly would be identical to the previously described assembly 30, except that a means of rotatably supporting the fixed lead screw 38 would be added. This could comprise a support member extending across the open face 26, a bracket attached to the side wall 20 having a size and configuration to support the end 104 of the fixed lead screw 38, or a flange 118 extending into the open face 26, as illustrated in FIG. 5. A suitable seat or bearing, as previously described, could be used to facilitate the supported rotation of the fixed lead screw 38.

The controller 58 could be configured to control the motors 58, 60, with the upper assembly controlled independently of the lower assembly. This would enable differing utensil loads and soil loads in the upper and lower portions of the wash chamber to be treated independently, thereby optimizing the cleaning operation for each utensil basket.

Figure 6:
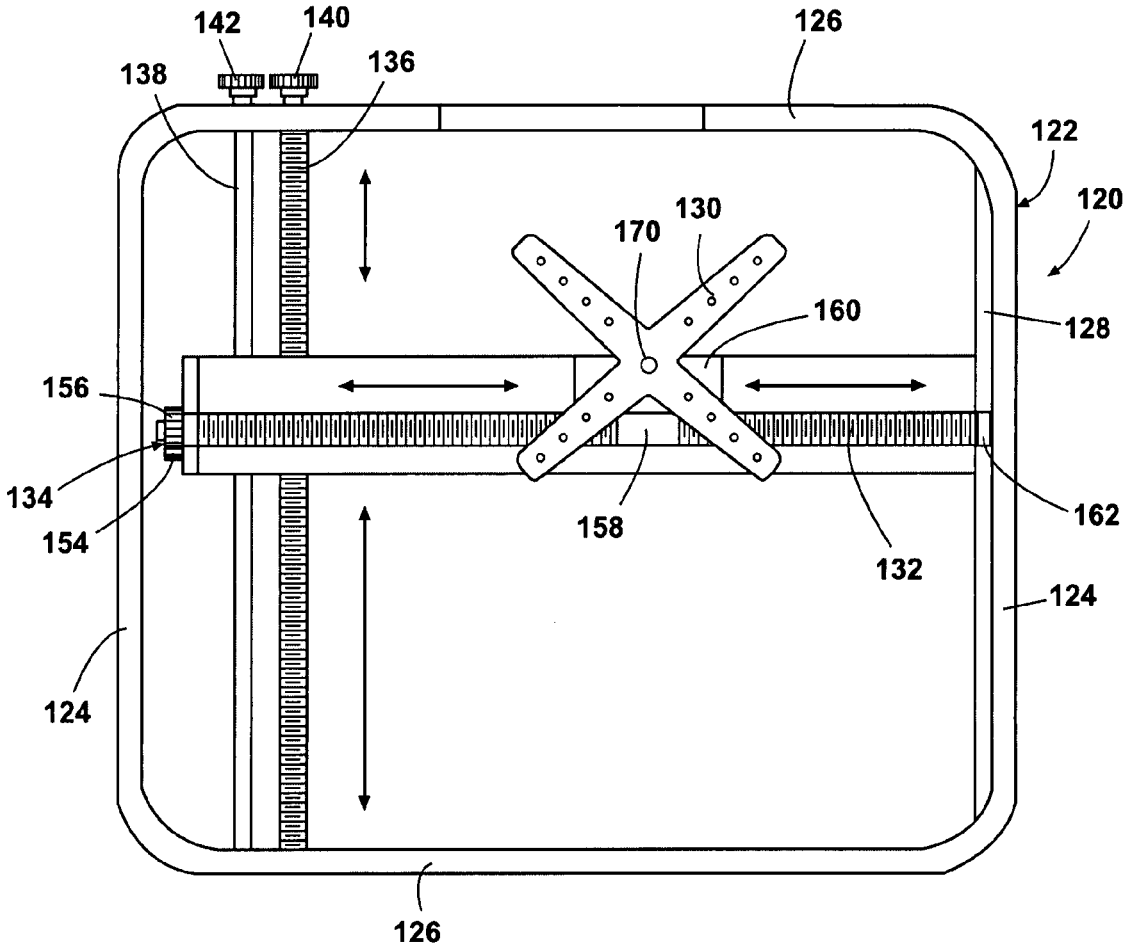
FIG. 6 is a plan view of a second embodiment of the targeted sensing and washing assembly illustrated in FIG. 1.
Figure 7:
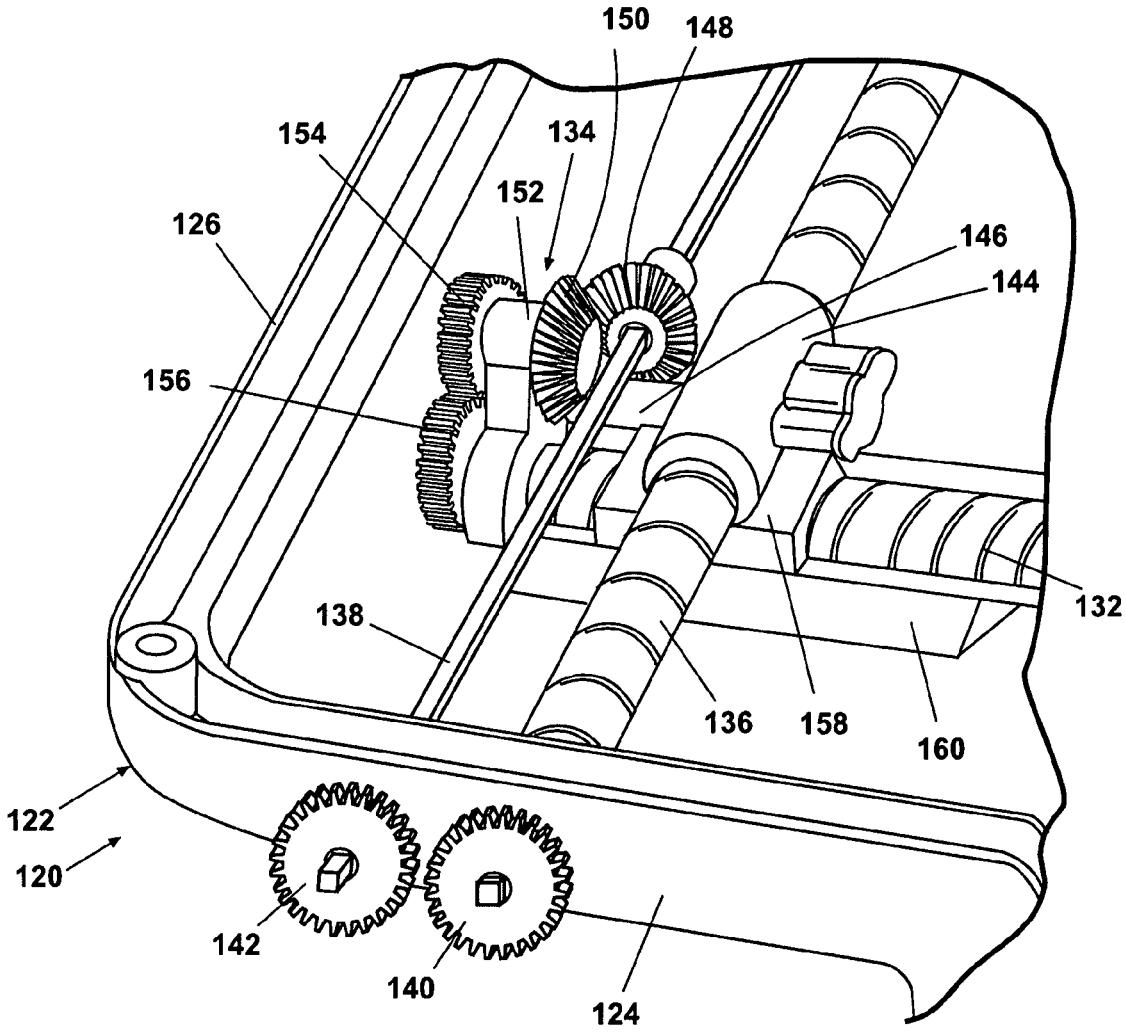
FIG. 7 is an enlarged perspective view from below of a movable sprayer comprising a portion of the targeted sensing and washing assembly illustrated in FIG. 6.
Figure 8:
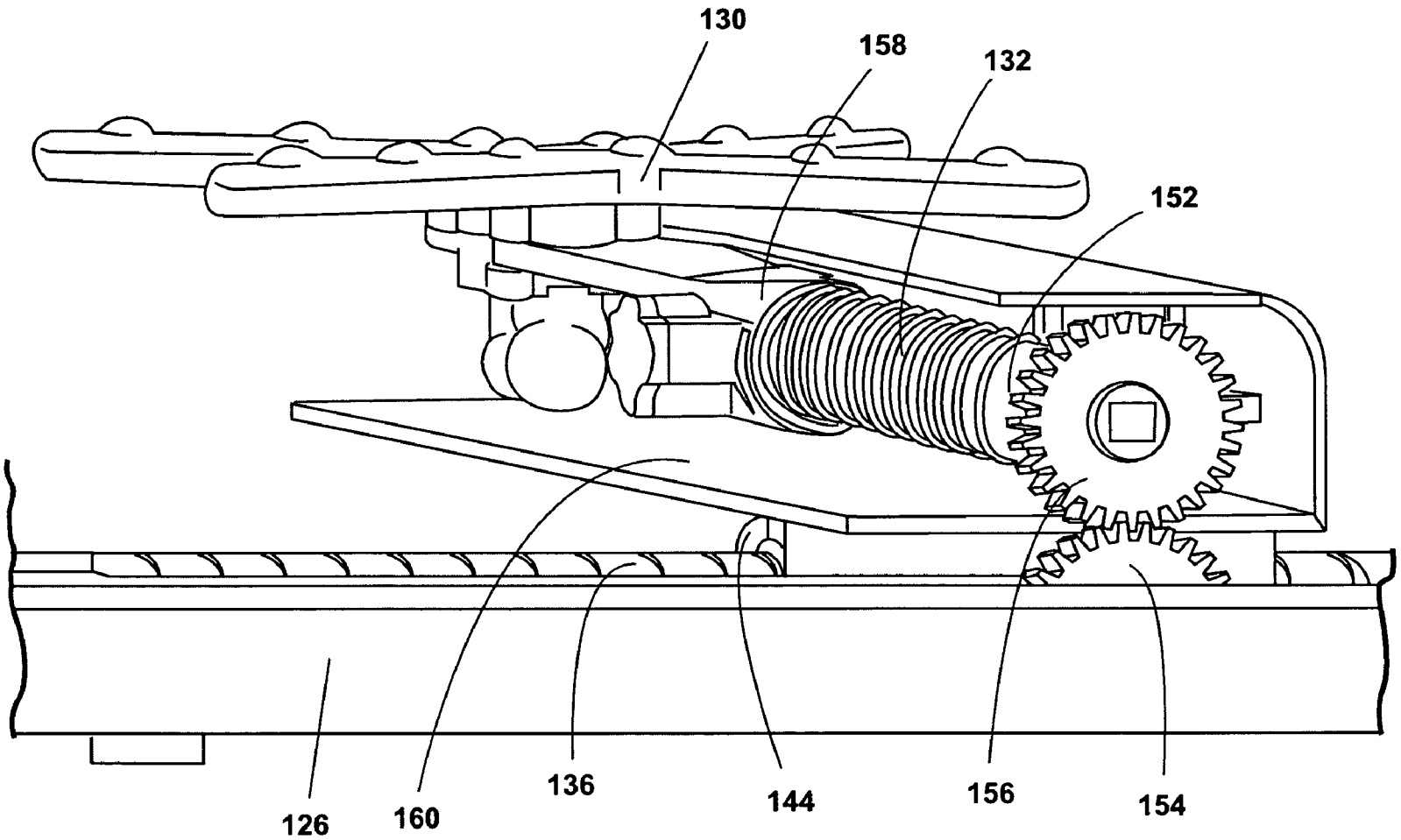
FIG. 8 is an enlarged perspective view from above of the movable sprayer illustrated in FIG. 7.

FIGS. 6-8 illustrate a second embodiment of the positionable sprayer assembly. In this embodiment, the movable sprayer assembly 120 is supported in a support frame 122 configured to fit within the wash chamber 24 as an integrated unit. The support frame 122 comprises a pair of spaced side rails 124 extending along the side walls 20 and connected by a pair of spaced end rails 126 to form a generally rectilinear frame 122. One of the side rails 124 is provided with an inwardly-directed flange 118 extending the length of the side wall 124. The sprayer 130 is similar to the sprayer 30 previously described herein, and is configured for delivering a rotating spray of wash liquid to utensils in the wash chamber 24. A sensor 70 is located in the center of the sprayer hub and connected to the controller 58 as previously described.

A transverse shaft 132 extends from side-to-side between the side rails 124, and is threaded generally as previously described. The transverse shaft 132 is operably coupled to a transmission 134, which in turn is coupled through a square drive shaft 138 to a first drive gear 142. The first drive gear 142 is configured for operable registry with a clutch assembly and drive motor (not shown) for selective rotation of the drive gear 142. A second drive gear 140 is configured for operable registry with a clutch assembly and drive motor (not shown) for selective rotation of the second drive gear 140, which is rotatably coupled to a drive shaft 136 extending generally orthogonally to, but spaced from, the transverse shaft 132. The drive shaft 136 is provided with threads as previously described. The clutch assembly and drive motor can be configured with a movable spur gear (not shown) that is selectively brought into engagement with either the first drive gear 142 or the second drive gear 140, or both concurrently.

A threaded collar 144 is configured for slidable fit with the drive shaft 136 so that rotation of the drive shaft 136 can result in longitudinal translation of the collar 144 relative thereto. The collar 144 is structurally connected to the transmission 134 so that the transmission 134 can move parallel to the drive shaft 136 with translation of the collar 144 there along. The structural connection is provided through a suitable support piece 146 having sufficient strength for the purposes described herein.

The transmission comprises a pair of beveled transfer gears 148, 150. The first beveled transfer gear 148 operably engages the driven shaft 138 for rotation with the rotation of the driven shaft 138. The connection of the beveled transfer gear 148 with the driven shaft 138 enables the beveled transfer gear 148 to slide along the driven shaft 138 with translation of the transmission 134. The beveled transfer gear 150 is coupled through a common shaft to a first transfer gear 154, which in turn is coupled to a second transfer gear 156. The beveled transfer gears 148, 150 and the transfer gears 154, 156 are supported in proper alignment by a support sleeve 152 having sufficient strength and durability for the purposes intended. The transfer gear 156 is coaxially coupled to the transverse shaft 132 for rotation of the transverse shaft 132 with the rotation of the transfer gear 156. The transverse shaft 132 is operably coupled to a support carriage 160 for translation of the support carriage 160 along the transverse shaft 132 with rotation of the transverse shaft 132. The support carriage 160 is separate from the collar 144 for independent movement of the carriage 160 and the collar 144.

As described previously, the drive gears 140, 142 can be operably coupled with a source of power, such as an electric motor, for rotation of the drive gears 140, 142 with operation of the motor. As illustrated in FIG. 7, rotation of the second drive gear 140 can result in rotation of the drive shaft 136. The rotation of the drive shaft 136 can urge the longitudinal translation of the collar 144 along the drive shaft 136. Rotation of the first drive gear 142 can urge the rotation of the driven shaft 138. This can urge the rotation of the double transfer gear 148 and the beveled transfer gear 150. Rotation of the beveled transfer gear 150 can urge the rotation of the transfer gear 154 and the transfer gear 156, which can rotate the transfer shaft 132, thereby urging the support carriage 160 into longitudinal motion along the transverse shaft 132. Selective movement of the support carriage 160 can be effected through the selective actuation of the transverse shaft 132 and the drive shaft 136 independently of each other.

Other means of locating the sprayer 34 in orthogonal directions will be evident to a person of ordinary skill in the art. For example, a hydraulic-type pump can be utilized to control the operation of the orthogonal lead screws, using the wash liquid as a hydraulic fluid. This could be incorporated into the pump that is utilized to supply wash liquid to the sprayer 34. A diverter valve could be incorporated into the pump assembly to selectively deliver liquid from the pump to actuators coupled to each lead screw for operation of each shaft independently of the other.

The sprayer assembly 30 has been described and illustrated as an embodiment comprising a propeller-type sprayer movable in a generally horizontal plane. Other sprayer configurations can be utilized. For example, the sprayer assembly 30 can comprise a propeller-type sprayer movable in a generally vertical plane. In such an embodiment, the lead screws would be mounted adjacent a side wall or the rear wall and configured for movement of the sprayer in top-to-bottom and side-to-side directions. Other embodiments can comprise a nozzle-type sprayer having a fixed or movable attachment to the sprayer carriage for movement in either a generally horizontal plane or a generally vertical plane. The sprayer assembly can also comprise an array of wall-mounted nozzle-type sprayers. The wall-mounted sprayers can be individually controllable, or controllable in selected groups, to deliver a spray of wash liquid to a selected area of the wash chamber based upon an output from one or more utensil load sensors and soil load sensors. The horizontally-movable sprayer assembly 30, or a vertically-movable sprayer assembly, can be utilized in combination with wall-mounted spray nozzles providing a zone wash function, which can all be controllable to deliver wash liquid to a selected area of the wash chamber based upon an output from one or more utensil load sensors and soil load sensors.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An automatic dishwasher comprising:

a housing defining a wash chamber having an open face providing access to the wash chamber;

a door moveably mounted to the housing to selectively close the open face;

at least one basket located within the wash chamber for holding utensils;

a liquid recirculation system for recirculation liquid within the wash chamber to remove soil on the utensils and having a movable portion that moves within the wash chamber by bi-directionally translating along two orthogonal directions in a horizontal plane relative to the basket;

a liquid source comprising a flexible liquid delivery line located within the wash chamber;

a sensor carried by the movable portion of the liquid recirculation system for determining a utensil load at different portion of the basket; and a controller operably coupled to the movable portion and the movable sensor to control the path of movement of the movable sensor by controlling the bi-directional translational movement of the movable portion along two orthogonal directions in a horizontal plane relative to the basket to determine the presence of a utensil load at different portions of the basket when the door to the open face is closed and during a running of a dishwashing cycle;

wherein the movable portion may be moved bi-directionally along the two orthogonal directions to effect a corresponding movement of the movable portion within the wash chamber.

2. An automatic dishwasher according to claim 1, wherein the different portions of the wash chamber comprise different quadrants of the basket.

3. An automatic dishwasher according to claim 1, wherein the sensor is movably mounted relative to the basket in the wash chamber for bi-directionally translational movement to and from different quadrants.

4. An automatic dishwasher according to claim 3, wherein the movable sensor can be selectively positioned relative to the basket within the wash chamber.

5. An automatic dishwasher according to claim 4, wherein the movable sensor can be selectively positioned relative to the basket along at least one of two non-parallel axes.

6. An automatic dishwasher according to claim 5, wherein the two non-parallel axes are orthogonal axes.

7. An automatic dishwasher according to claim 1, wherein the sensor determines the presence of the utensils in each of the different portions of the basket within the washing chamber.

8. An automatic dishwasher according to claim 7, wherein there is a single sensor that determines the presence of utensils in each of the different portions of the basket within the washing chamber.

9. An automatic dishwasher according to claim 8, wherein the single sensor is moveable in a bi-directionally translational direction, along two orthogonal directions, relative to the basket within the wash chamber to different portions.

10. An automatic dishwasher according to claim 1, wherein the sensor comprises at least one of an optical sensor, magnetic sensor, temperature sensor, density sensor, acoustic sensor, pressure sensor, and near infrared light sensor.

11. An automatic dishwasher comprising:

a wash tub defining a wash chamber having an open face providing access to the wash chamber;

a door moveably mounted to a housing to selectively close the open face;

at least one basket located within the wash chamber for holding utensils;

a sprayer carriage moveably mounted within the wash chamber for bi-directionally translational movement along two orthogonal directions in a horizontal plane relative to the basket within the wash chamber;

a liquid source comprising a flexible liquid delivery line located within the wash chamber;

a spray arm mounted to the moveable sprayer carriage for cooperative bi-directional translation movement along two orthogonal directions in a horizontal plane relative to the basket within the wash chamber, fluidly coupled to the flexible liquid delivery line, and rotatably mounted to the sprayer carriage moveably mounted relative to the basket within the wash chamber for rotation about a rotational axis to spray liquid to different portions of the basket throughout the wash chamber;

a sensor mounted to at least one of the sprayer carriage moveably mounted relative to the basket within the wash chamber and spray arm and outputting a signal for use in determining a load value at different portions of the basket; and a controller operably coupled to the sprayer carriage moveably mounted relative to the basket to control the direction of bi-directionally translational movement of the sprayer carriage through different portions of the basket within the wash chamber and operably coupled to the sensor to receive the signal at different portions and determine the load value in the different portions of the basket when the door to the open face is closed and during a running of a dishwashing cycle;

wherein the sprayer carriage may be moved bi-directionally along the two orthogonal directions to effect a corresponding movement of the spray arm within the wash chamber, and the flexible liquid delivery line moves with the spray arm to supply liquid to the spray arm while the spray arm is moving.

12. An automatic dishwasher according to claim 11, wherein different portions of the wash chamber comprise different quadrants of the basket.

13. An automatic dishwasher according to claim 11, wherein the sprayer carriage is movably mounted relative to the basket in the wash chamber for bi-directional translational movement to and from different quadrants.

14. An automatic dishwasher according to claim 11, wherein the sprayer carriage can be selectively positioned relative to the basket within the wash chamber.

15. An automatic dishwasher according to claim 11, wherein the sprayer carriage can be selectively positioned relative to the basket along at least one of two non-parallel axes.

16. An automatic dishwasher according to claim 15, wherein the two non-parallel axes are orthogonal axes.

17. An automatic dishwasher according to claim 11, wherein the sensor determines the presence of the utensil in each of the different portions of the basket within the washing chamber.

18. An automatic dishwasher according to claim 17, wherein there is a single sensor that determines the presence of the utensils in each of the different portions of the basket within the washing chamber.

19. An automatic dishwasher according to claim 18, wherein the single sensor is moveable in a bi-directionally translational direction, along two orthogonal directions, relative to the basket within the wash chamber to different portions.

20. An automatic dishwasher according to claim 11, wherein the sensor comprises at least one of an optical sensor, magnetic sensor, temperature sensor, density sensor, acoustic sensor, pressure sensor, and near infrared light sensor.

* * * * *

UNITED STATES PATENT AND TRADEMARK OFFICE

CERTIFICATE OF CORRECTION

PATENT NO. : 7,935,194 B2
APPLICATION NO. : 11/845158
DATED : May 3, 2011
INVENTOR(S) : Robert Jacob Rolek It is certified that error appears in the above-identified patent and that said Letters Patent is hereby corrected as shown below:

Col. 10, lines 27-57, Claim 1: "An automatic dishwasher comprising: a housing defining a wash chamber having an open face providing access to the wash chamber; a door moveably mounted to the housing to selectively close the open face; at least one basket located within the wash chamber for holding utensils; a liquid recirculation system for recirculation liquid within the wash chamber to remove soil on the utensils and having a movable portion that moves within the wash chamber by bi-directionally translating along two orthogonal directions in a horizontal plane relative to the basket; a liquid source comprising a flexible liquid delivery line located within the wash chamber; a sensor carried by the movable portion of the liquid recirculation system for determining a utensil load at different portion of the basket; and a controller operably coupled to the movable portion and the movable sensor to control the path of movement of the movable sensor by controlling the bi-directional translational movement of the movable portion along two orthogonal directions in a horizontal plane relative to the basket to determine the presence of a utensil load at different portions of the basket when the door to the open face is closed and during a running of a dishwashing cycle; wherein the movable portion may be moved bi-directionally along the two orthogonal directions to effect a corresponding movement of the movable portion within the wash chamber." - should be Claim 1: -- An automatic dishwasher comprising: a housing defining a wash chamber having an open face providing access to the wash chamber; a door moveably mounted to the housing to selectively close the open face; at least one basket located within the wash chamber for holding utensils; a liquid recirculation system for recirculating liquid within the wash chamber to remove soil on the utensils and having a movable portion that moves within the wash chamber by bi-directionally translating along two orthogonal directions in a horizontal plane relative to the basket; a liquid source comprising a flexible liquid delivery line located within the wash chamber; a sensor carried by the movable portion of the liquid recirculation system for determining a utensil load at different portions of the basket; and a controller operably coupled to the movable portion and the movable sensor to control the path of movement of the movable sensor by controlling the bi-directional translational movement of the movable portion along two orthogonal directions in a horizontal plane relative to the basket to determine the presence of a utensil load at different portions of the basket when the door to the open face is closed and during a running of a dishwashing cycle; wherein the movable portion may be Signed and Sealed this
Tenth Day of January, 2012

David J. Kappos

David J. Kappos
*Director of the United States Patent and Trademark Office* moved bi-directionally along the two orthogonal directions to effect a corresponding movement of the movable portion within the wash chamber. --

Col. 11, lines 23-48 and Col. 12, lines 1-15, Claim 11: "An automatic dishwasher comprising: a wash tub defining a wash chamber having an open face providing access to the wash chamber; a door moveably mounted to a housing to selectively close the open face; at least one basket located within the wash chamber for holding utensils; a sprayer carriage moveably mounted within the wash chamber for bi-directionally translational movement along two orthogonal directions in a horizontal plane relative to the basket within the wash chamber; a liquid source comprising a flexible liquid delivery line located within the wash chamber; a spray arm mounted to the moveable sprayer carriage for cooperative bi-directional translation movement along two orthogonal directions in a horizontal plane relative to the basket within the wash chamber, fluidly coupled to the flexible liquid delivery line, and rotatably mounted to the sprayer carriage moveably mounted relative to the basket within the wash chamber for rotation about a rotational basket within the wash chamber for rotation about a rotational axis to spray liquid to different portions of the basket throughout the wash chamber; a sensor mounted to at least one of the sprayer carriage moveably mounted relative to the basket within the wash chamber and spray arm and outputting a signal for use in determining a load value at different portions of the basket; and a controller operably coupled to the sprayer carriage moveably mounted relative to the basket to control the direction of bi-directionally translational movement of the sprayer carriage through different portions of the basket within the wash chamber and operably coupled to the sensor to receive the signal at different portions of the basket when the door to the open face is closed and during a running of a dishwashing cycle; wherein the sprayer carriage may be moved bi-directionally along two orthogonal directions to effect a corresponding movement of the spray arm within the wash chamber, and the flexible liquid delivery line moves with the spray arm to supply liquid to the spray arm while the spray arm is moving." - should be Claim 11: -- An automatic dishwasher comprising: a wash tub defining a wash chamber having an open face providing access to the wash chamber; a door moveably mounted to a housing to selectively close the open face; at least one basket located within the wash chamber for holding utensils; a sprayer carriage moveably mounted within the wash chamber for bi-directionally translational movement along two orthogonal directions in a horizontal plane relative to the basket within the wash chamber; a liquid source comprising a flexible liquid delivery line located within the wash chamber; a spray arm mounted to the moveable sprayer carriage for cooperative bi-directional translational movement along two orthogonal directions in a horizontal plane relative to the basket within the wash chamber, fluidly coupled to the flexible liquid delivery line, and rotatably mounted to the sprayer carriage moveably mounted relative to the basket within the wash chamber for rotation about a rotational basket within the wash chamber for rotation about a rotational axis to spray liquid to different portions of the basket throughout the wash chamber; a sensor mounted to at least one of the sprayer carriage moveably mounted relative to the basket within the wash chamber and spray arm and outputting a signal for use in determining a load value at different portions of the basket; and a controller operably coupled to the sprayer carriage moveably mounted relative to the basket to control the direction of bi-directionally translational movement of the sprayer carriage through different portions of the basket within the wash chamber and operably coupled to the sensor to receive the signal at different portions of the basket when the door to the open face is closed and during a running of a dishwashing cycle; wherein the sprayer carriage may be moved bi-directionally along two orthogonal directions to effect a corresponding movement of the spray arm within the wash chamber, and the flexible liquid delivery line moves with the spray arm to supply liquid to the spray arm while the spray arm is moving. --